US010338537B2

(12) United States Patent
Braunberger

(10) Patent No.: US 10,338,537 B2
(45) Date of Patent: Jul. 2, 2019

(54) INDICATORS FOR EXTERNAL VARIABLES CONSISTING OF SINGULAR AND MULTIPLE DEPLETION CELLS

(71) Applicant: Vision Works IP Corporation, Sequim, WA (US)

(72) Inventor: Fritz Braunberger, Sequim, WA (US)

(73) Assignee: Vision Works IP Corporation, Sequim, WA (US)

( * ) Notice: Subject to any disclaimer, the term of this patent is extended or adjusted under 35 U.S.C. 154(b) by 0 days.

(21) Appl. No.: 14/843,876

(22) Filed: Sep. 2, 2015

(65) Prior Publication Data

US 2016/0070237 A1 Mar. 10, 2016

Related U.S. Application Data

(60) Provisional application No. 62/050,586, filed on Sep. 15, 2014, provisional application No. 62/049,308, filed on Sep. 11, 2014, provisional application No. 62/047,595, filed on Sep. 8, 2014.

(51) Int. Cl.
*G04F 13/04* (2006.01)
*G04R 20/28* (2013.01)

(52) U.S. Cl.
CPC ..... *G04F 13/04* (2013.01); *G04R 20/28* (2013.01)

(58) Field of Classification Search
CPC ..... G04F 13/04; G04F 1/00; G04F 1/066; G01K 3/04; G01N 31/229; G04R 20/26; G04R 20/28; G04R 20/30
See application file for complete search history.

(56) References Cited

U.S. PATENT DOCUMENTS 2,651,755 A 9/1953 Triplett
3,119,754 A 1/1964 Blumenfeld et al.
3,138,686 A * 6/1964 Mitoff ..... H01C 7/022 252/502
3,210,662 A 10/1965 Steinmetz et al.
3,336,212 A 8/1967 Nicholas
(Continued)

FOREIGN PATENT DOCUMENTS

WO 2001/82006 A1 11/2001
WO 2003/052524 A2 6/2003
(Continued)

OTHER PUBLICATIONS

International Search Report and Written Opinion from the International Application No. PCT/US18/17861.

*Primary Examiner* — Sean P Kayes
(74) *Attorney, Agent, or Firm* — Haverstock & Owens LLP

(57) ABSTRACT

Electrochemical indicators are configured to indicate a variable such as time and/or a temperature excursion. In some embodiments, the electrochemical indicators comprise an anode layer and a cathode layer which contact an electrolyte to activate each indicator. In some embodiments, the electrochemical indicator comprises an electrically isolated RFID chip and an RFID antenna which are placed in electrical communication in response to the external variable. The completed RFID tag may then be read by an RFID reader. A completed RFID tag may also be incorporated within the electrochemical indicators comprising an anode layer and a cathode layer and where the RFID tag is unshielded and becomes readable as the indicator expires.

34 Claims, 12 Drawing Sheets

(56) References Cited

U.S. PATENT DOCUMENTS 3,512,049 A 5/1970 Hoberman
3,543,582 A 12/1970 Sessler
3,564,347 A 2/1971 Peck
3,613,002 A 10/1971 Trenkler et al.
3,638,120 A 1/1972 Jost
3,768,015 A 10/1973 Moser
3,849,657 A 11/1974 Hamblem
3,942,467 A 3/1976 Witonsky
3,967,579 A 7/1976 Seiter
3,974,495 A 8/1976 Jones
3,977,900 A 8/1976 Luehrs
3,999,946 A 12/1976 Patel et al.
4,044,707 A 8/1977 Bryne
4,084,511 A 4/1978 Svrjcek
4,100,490 A 7/1978 Peck
4,153,345 A 5/1979 Duchene et al.
4,212,153 A 7/1980 Kydonieus et al.
4,277,974 A 7/1981 Karr et al.
4,308,486 A 12/1981 Gange
4,314,874 A 2/1982 Abe et al.
4,327,117 A 4/1982 Lenack et al.
4,392,236 A 7/1983 Sandstorm et al.
4,408,557 A 10/1983 Bradley
4,431,313 A 2/1984 Hemperly
4,488,780 A 12/1984 Nicholson
4,505,595 A 3/1985 Rose et al.
4,527,522 A 7/1985 Cerny
4,629,330 A 12/1986 Nichols
4,646,066 A 2/1987 Baughman
4,797,864 A 1/1989 Stano et al.
4,804,275 A 2/1989 Kang et al.
4,844,622 A 7/1989 Weiss
4,860,269 A 8/1989 Hennings et al.
4,929,090 A 5/1990 Grahm
5,034,233 A 7/1991 McCoy, Jr.
5,045,283 A 9/1991 Patel
5,053,339 A 10/1991 Patel
5,085,802 A 2/1992 Jalinski
5,182,212 A 1/1993 Jalinski
5,254,473 A 10/1993 Patel
5,317,987 A 6/1994 Muller
5,339,024 A 8/1994 Kuo et al.
5,368,905 A 11/1994 Ohno
5,396,177 A 3/1995 Kuo
5,418,086 A 5/1995 Bailey
5,420,000 A 5/1995 Patel et al.
5,446,705 A 8/1995 Haas
5,544,925 A 8/1996 Ikeda
5,555,223 A 9/1996 Barainsky
5,602,804 A 2/1997 Haas
5,633,835 A 5/1997 Haas et al.
5,667,303 A 9/1997 Arens et al.
5,672,465 A 9/1997 Patel et al.
5,673,028 A 9/1997 Levy
5,699,326 A 12/1997 Haas et al.
5,709,472 A 1/1998 Prusik et al.
5,719,828 A 2/1998 Haas et al.
5,756,356 A 5/1998 Yangai et al.
5,785,354 A 7/1998 Haas
5,797,344 A 8/1998 Rothschild et al.
5,802,015 A 9/1998 Rothschild et al.
5,822,280 A 10/1998 Haas
5,830,683 A 11/1998 Hendricks et al.
5,912,759 A 6/1999 Good et al.
5,930,023 A 6/1999 Mitchell, Jr. et al.
5,930,206 A 7/1999 Haas et al.
5,947,369 A 9/1999 Frommer et al.
5,959,295 A 9/1999 Braun
5,989,852 A 11/1999 Hendricks et al.
5,997,927 A 12/1999 Gics
6,042,264 A 3/2000 Prusik et al.
6,103,351 A 8/2000 Ram et al.
6,113,857 A 9/2000 Manico et al.
6,198,701 B1 3/2001 De Jonghe et al.
6,243,192 B1 6/2001 Mitchell, Jr. et al.
6,244,208 B1 6/2001 Qiu et al.
6,269,764 B1 8/2001 Adamy et al.
6,285,492 B1 9/2001 Good et al.
6,295,252 B1 9/2001 Holt et al.
6,331,076 B1 12/2001 Coll
6,373,786 B1 4/2002 Kagan et al.
6,426,503 B1 7/2002 Wuest
6,435,128 B2 8/2002 Qiu et al.
6,452,873 B1 9/2002 Holt et al.
6,544,925 B1 4/2003 Prusik et al.
6,750,458 B1 6/2004 Rourk
6,801,477 B2 10/2004 Braunberger
6,826,119 B2 11/2004 Fortune
6,968,804 B1 11/2005 Barbieri
6,974,249 B1 12/2005 Fair
7,079,452 B2 7/2006 Harrison
7,215,976 B2 5/2007 Brideglall
7,254,095 B1 8/2007 Braunberger
7,294,379 B2 11/2007 Ko et al.
7,362,663 B2 * 4/2008 Kagan ..... G04F 1/005 368/327
7,372,780 B1 5/2008 Braunberger
7,463,558 B2 12/2008 Braunberger
7,476,874 B2 1/2009 Patel
7,489,596 B2 2/2009 Kuczynski
7,589,331 B2 9/2009 Havens
8,018,347 B2 9/2011 Tehrani et al.
8,077,553 B2 * 12/2011 Braunberger ..... G04F 13/04 116/206
8,503,269 B2 * 8/2013 Braunberger ..... G04F 13/04 116/206
8,717,854 B2 * 5/2014 Braunberger ..... G04F 13/04 116/206
8,727,209 B1 5/2014 Shih
8,800,472 B2 8/2014 Park
9,188,962 B2 * 11/2015 Braunberger ..... G04F 13/04
2003/0053377 A1 3/2003 Spevacek
2003/0104353 A1 6/2003 Brielmeier et al.
2003/0104848 A1 6/2003 Brideglall
2003/0112711 A1 6/2003 Braunberger
2003/0151985 A1 8/2003 Braunberger
2003/0152483 A1 8/2003 Munagavalasa et al.
2004/0092023 A1 5/2004 Wright
2004/0232052 A1 11/2004 Call et al.
2005/0248455 A1 11/2005 Pope et al.
2005/0276165 A1 12/2005 Chien
2006/0145091 A1 7/2006 Patel
2006/0145863 A1 7/2006 Martin et al.
2006/0227669 A1 * 10/2006 Pennaz ..... G04F 13/04 368/327
2006/0260534 A1 11/2006 Petrakis
2007/0064541 A1 3/2007 Kagan
2007/0089433 A1 4/2007 McDonell et al.
2007/0268785 A1 11/2007 Braunberger
2008/0023362 A1 1/2008 Genosar
2008/0043804 A1 2/2008 Goldsimth et al.
2008/0210152 A1 9/2008 Robinson et al.
2009/0010304 A1 1/2009 Skinner et al.
2009/0016176 A1 * 1/2009 Braunberger ..... G04F 13/04 368/327
2009/0266291 A1 10/2009 Braunberger
2009/0303041 A1 12/2009 Tehrani et al.
2010/0149929 A1 6/2010 Braunberger
2010/0219351 A1 9/2010 Roberts et al.
2010/0251955 A1 10/2010 Knoll
2010/0275835 A1 11/2010 Su et al.
2011/0017123 A1 1/2011 Maschietti et al.
2011/0037541 A1 2/2011 Johnson et al.
2011/0084128 A1 4/2011 Haarer et al.
2011/0096388 A1 4/2011 Agrawal
2011/0286314 A1 * 11/2011 Braunberger ..... G04F 13/04 368/327
2012/0256727 A1 10/2012 Moore, Jr.

(56) References Cited

U.S. PATENT DOCUMENTS

| | | | |
|---|---|---|---|
| 2013/0107676 | A1 | 5/2013 | Braunberger |
| 2016/0012310 | A1 | 1/2016 | Kozicki |

FOREIGN PATENT DOCUMENTS

| | | | |
|---|---|---|---|
| WO | 2004/077172 | A2 | 9/2004 |
| WO | 2009/038806 | A1 | 3/2009 |
| WO | 2010/0099340 | A2 | 9/2010 |
| WO | 2011098830 | A1 | 8/2011 |

* cited by examiner

Etched Anode Cells & Common Cathode

UV Coated Cells with Ingress

UV Coated Cells with Ingress

1300

1300

INDICATORS FOR EXTERNAL VARIABLES CONSISTING OF SINGULAR AND MULTIPLE DEPLETION CELLS

RELATED APPLICATIONS

This patent application claims priority under 35 U.S.C. 119(e) of the the U.S. provisional patent application, Application No. 62/047,595, filed on Sep. 8, 2014, and entitled "eLabel electro-chemical-time/temperature indicator (eTTI), Generic indicator (GI) for external variables consisting of a singular or multiple eCells", the U.S. provisional patent application, Application No. 62/049,308, filed on Sep. 11, 2014, and entitled "eLabel electro-chemical-time/temperature indicator (eTTI), Generic indicator (GI) for external variables consisting of a singular or multiple eCells", and the U.S. provisional patent application, Application No. 62/050,586, filed on Sep. 15, 2014, and entitled "eLabel electro-chemical-time/temperature indicator (eTTI), Generic indicator (GI) for external variables consisting of a singular or multiple eCells", which are all hereby incorporated in its entirety by reference.

FIELD OF THE INVENTION

The present invention relates to timing systems, visual indicators and devices and methods for making the same. More specifically, the invention relates to systems, devices and methods of indicating and/or recording; the passage of a duration of time.

BACKGROUND OF THE INVENTION

There are a number of different timing systems and devices, generally referred to as time-temperature indicators (TTIs), which can be used to monitor the exposure of objects to a range of temperatures over a specified period of time. Time-temperature indicators can have a number of different applications for indicating when an event or activity needs to take place. For example, time-temperature indicators have applications for indicating when the perishable materials have expired and need to be thrown out. Time-temperature indicators also have applications for general inventory management, for monitoring projects, activities and a host of other time and/or temperature dependent events. Therefore, there is a continued need to develop reliable timing systems and devices which can be used for a variety of different applications.

Color changing labels exist which utilize an electrochemical reaction to deplete a thin metallic film which upon depletion allows for a visual discernment of whatever resides beneath. Such labels are manufactured in a variety of configurations but may suffer from manufacturing, depletion, and depletion problems. Additionally, such device may be unduly susceptible to unwanted external variables.

SUMMARY OF THE INVENTION

The present invention is directed to electrochemical indicators for indicating a variable such as time and/or a temperature excursion. In some embodiments, the electrochemical indicators comprise an anode layer and a cathode layer which contact an electrolyte to activate each indicator. In some embodiments, the electrochemical indicator comprises an electrically isolated RFID chip and/or an RFID antenna which are placed in electrical communication in response to the external variable. The completed RFID tag may then be read by a RFID reader. A completed RFID tag may also be incorporated within the electrochemical indicators comprising an anode layer and a cathode layer and where the RFID tag is unshielded and becomes readable as the indicator expires.

In one aspect, an electrochemical timing device comprises a lens for viewing a expiration of the timing device, a base, a cathode layer coupled to the lens and the base; an anode layer comprising a plurality of coated non-metalized sections and coupled to the lens and the base, and an electrolyte, wherein the timing device is activated when the electrolyte comes into contact with the anode layer and the cathode layer, and wherein the electrolyte is prevented from migrating past an edge of depletion by the coated non-metalized sections of the anode layer after the timing device is activated. The anode layer is uniformly depleted from the leading edge across the anode layer. In some embodiments, the electrolyte comprises an unactive solid state that becomes active when the electrolyte liquefies. In these embodiments, the electrolyte liquefies at a predefined temperature activating the device. In some embodiments, one or more of a color, text, and a graphic is uncovered as the timing expires. An RFID antenna may be unshielded to radio frequency as the timing device expires and can be read for temperature excursion information of the timing device. In some embodiments, the device comprises one or more temperature dependent regulators for increasing an accuracy of the device. In some embodiments, the anode layer comprises one or more wedge-shaped plates with an electrolyte ingress point at a smaller end of each plate.

In another aspect, an electrochemical timing system comprises a lens, a base, a plurality of electrically segregated anode cells deposited between the lens and the base and a common cathode layer which covers an entire surface area of the plurality of anode cells. Cell segregation may be accomplished by etching a sheet of anode material to separate the anode material into the plurality anode cells. In some embodiments, the timing system is activated by introducing a quantity of electrolyte into the system. In some embodiments, the plurality of anode cells are sealed in a manner to allow ingress by an electrolyte at a discrete point. In further embodiments, each of the plurality of anode cells comprises a temperature dependent resistor (TDR). The plurality of anode cells may be coated with a UV activated liquid. In some embodiments, the plurality of anode cells are sequentially activated.

In a further aspect, an electrochemical timing system comprises an anode layer, a cathode layer, a quantity of electrolyte, wherein when the electrolyte contacts the anode layer and the cathode layer the timing system is activated and the anode layer begins to deplete in a direction away from an edge of depletion, and an RFID tag underlying the anode layer. In some embodiments, the RFID antenna is unshielded and becomes readable as anode layer is depleted. In some embodiments, the timing system is configured to indicate a temperature excursion. The electrolyte is able to comprise an unactive solid state electrolyte that liquefies at a predefined temperature to become active and activate the device. In some embodiments, an RFID antenna of the RFID tag is electrically decoupled from an RFID antenna. In some of these embodiments, a temperature activated switch of the RFID tag changes state when the timing system reaches a defined temperature causing the RFID tag to become active or non-active. In some embodiments, the temperature activated switch comprises a low melting point substance. In some of these embodiments, the low melting point substance does not conduct between contacts when solid and conducts between contacts when in a liquid state. Alternatively, in some embodiments, the low melting point substance conducts between contacts when solid and does not conduct between contacts when in a liquid state.

DETAILED DESCRIPTION OF THE EMBODIMENTS

Reference will now be made in detail to implementations of indicators for external variables consisting of singular and multiple depletion cells. Each indicator may be configured to indicate a passage of time. Additionally, each indicator may be configured with an applicator to be used as a label and/or attached to an additional object. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

EXAMPLE 1

Immersion Vs. Edge Depletion

Figure 1:
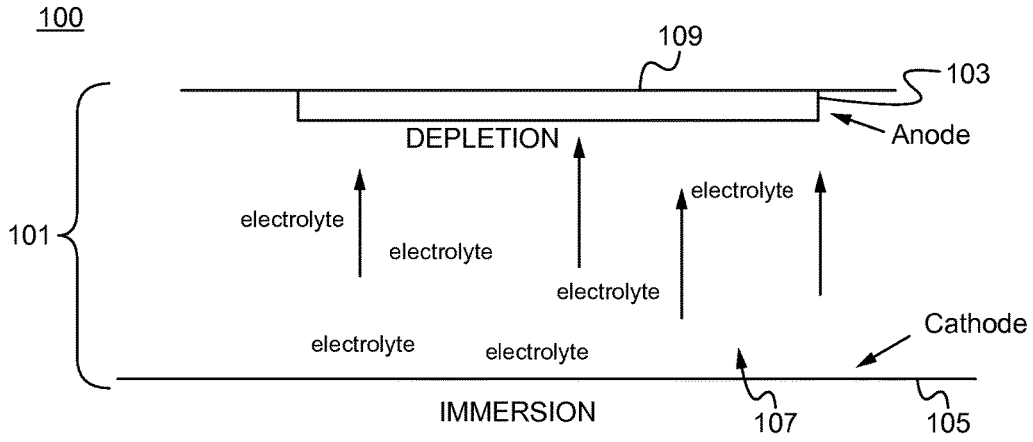
FIG. 1 illustrates an electrochemical timing system in accordance with some embodiments.

Referring now to FIG. 1, an electrochemical timing system is depicted therein. The timing system comprises a timer body 101 consisting of an anode layer 103, a cathode layer 105 and an electrolyte 107. The anode layer 103 is at least partially immersed within the electrolyte 107. The timing system 100 depletes across the timer body 101 to display a visual change and indicate a passage of time.

In some embodiments, the electrochemical depletion of the thin film anode 103 occurs because the anode 103 is at least partially immersed within the electrolyte 107. The timing system 100 depletes from a bottom of the body 101 up toward a lens 109 with depletion occurring across the entire footprint of the thin film anode 103 at one time. Problems may arise however, in that during the final stages of anode 103 depletion, needed electron paths may brake. From the oxidation process of the anode layer 103 these electron paths become broken and electrical paths needed for the electrons to flow to the cathode 105 are severed. Consequently, islands of un-depleted anode material 103 are left. The result is a visual obscurement limiting the effectiveness of the timing device 100. Particularly, the un-depleted anode layer 103 may block the visual change and may also be used as a shield against RF radiation from contacting an underlying RFID antenna. In such cases, un-depleted anode islands also hinder RF radiation exposure by the RFID antenna.

Figure 2:
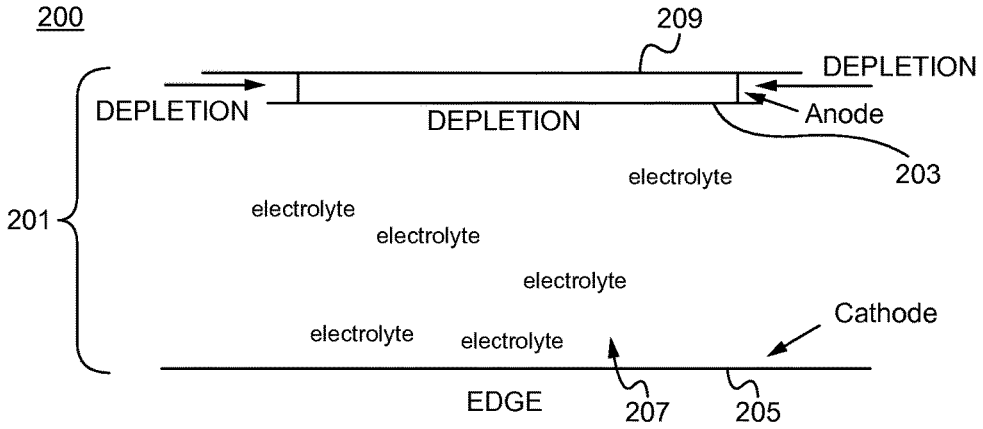
FIG. 2 illustrates an electrochemical timing system in accordance with some embodiments.

FIG. 2 illustrates an electrochemical timing system according to some further embodiments. Similar to the timing system as depicted in FIG. 1, the system 200 comprises a timer body 201 consisting of an anode layer 203, a cathode layer 205 and an electrolyte 207. However, as shown within FIG. 2, the anode layer 203 is depleted starting from an edge of the body 201 and migrating laterally until the entire anode 203 becomes depleted. The electrolyte 207 is prevented from migrating past the leading edge of the anode 203 by a coated top layer and a coated bottom layer and can only migrate as a result of depleting exposed areas of the anode 203. Since the only exposed area is that of an edge or a cross section, depletion must occur at each cross-sectional area of the anode 203 before it is allowed to migrate. Consequently, all of the anode material 203 becomes depleted and no anode 203 remnant remains.

EXAMPLE 2

Common Cathode, Multi-Cell, Anode Segregation

In some instances a depletion of a thin film anode layer occurs from one cell and progresses to adjacent cells within a timing system comprising multiple cells. In such cases, the cells may have been defined and/or physically segregated by cathode material. Within a multiple cell configuration, many slivers of cathode material are then needed to be assembled within the timing system. The manufacturing of such comb-like cathode material presents a challenge.

Figure 3:
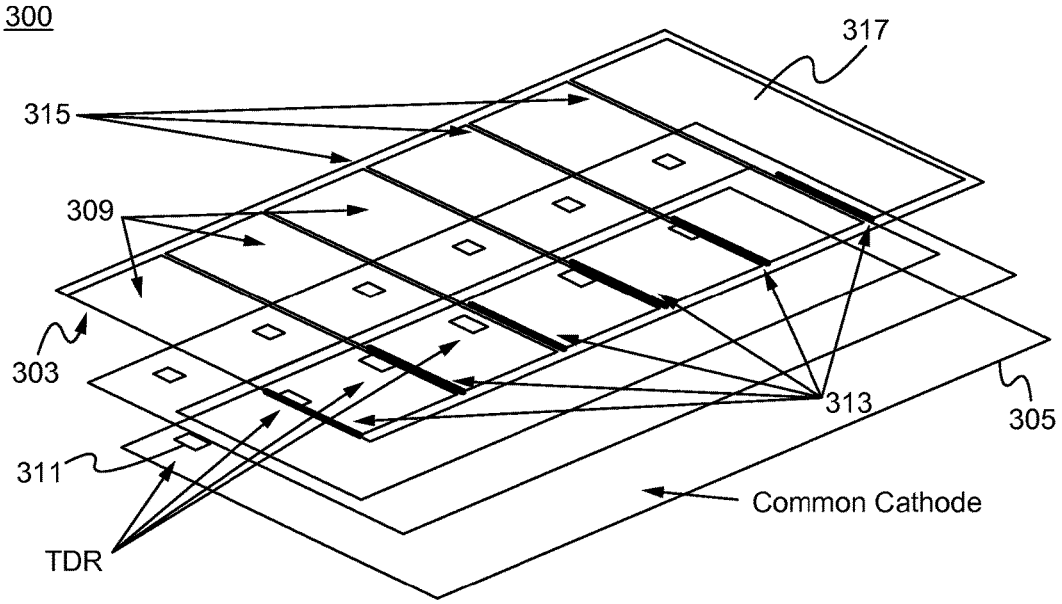
FIG. 3 illustrates an exploded view of an electrochemical timing system in accordance with some embodiments.

FIG. 3 illustrates an exploded view of an electrochemical timing system in accordance with further embodiments. As shown within FIG. 3, the timing system 300 comprises an anode layer 303 consisting of a grouping of multiple anode cells 309 and a common underlying cathode layer 305. Each anode cell 309 is separated by laser etching 315 at the border of the cell 309. Each cell 309 also comprises an area of ingress 313 to allow ingress by an electrolyte when desired.

The timing system 300 consists of a common cathode layer 305 without separation, running the length of, or covering the entire surface area of the anode cells 309. The anode cell 309 definition or segregation is accomplished by the laser etching 315 of the anode layer 301 to create the anode cells 309 which are electrically separated into cells and/or segments. Etching replaces segregating the cells 309 by assembling the comb-like slivers of cathode material in order to separate the anode cells 309.

As described above, the anode cells 309 are defined by electrically segregating the anode material 303 which has been thin film deposited onto an internal side of an overlying lens material 317. The cells 309 are laser etched into specific shapes by etching the anode material 303 to electrically separate the cells 309 into the desired shapes. Additionally, the cells 309 are sealed in such a manner to allow an ingress by an electrolyte only where desired. In some embodiments, the cell 309 shape and the area of ingress 313 are strategically placed such that a more rapid depletion of the anode cells 309 or specific pattern of depletion will occur. In such a case, each cell (being defined as only having one temperature dependent resistor (TDR) in series with the cathode) sometimes referred to as an eCell, may have multiple ingress points 313. Each eCell may have a separate TDR with an independent resistant value. This allows for a more rapid or slower depletion of adjacent cells 309, by increasing or decreasing the value of resistance within the TDR. In this way a more rapid or slower visual change can be accomplished.

Figure 4:
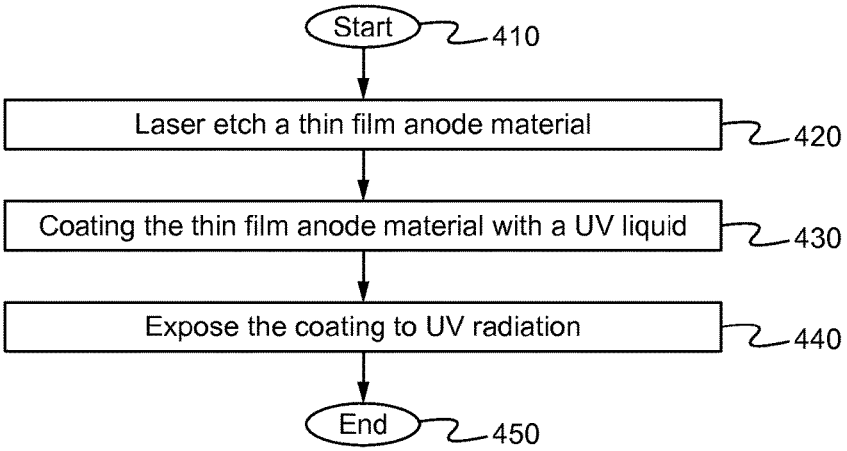
FIG. 4 illustrates a method of manufacturing an electrochemical timing cell in accordance with some embodiments.

Referring now to FIG. 4, a method of manufacturing an electrochemical timing cell is depicted therein. Although FIG. 4 illustrates the manufacturing of a single cell, it is anticipated that the method may be used to manufacture adjacent cells within a timing system comprising multiple cells, such as described above. The method begins in the step 410. In the step 420, a thin-film anode material is laser etched, such as described above. The thin-film anode layer is coated onto polymer sheets and is laser etched into the desired cell shapes. A metal coating such as Aluminum (Al) is etched from the sheet leaving the transparent polymer. A typical coating thickness may be 500 angstroms, so that laser etching may occur at high speeds. A laser-direct-pattern-etching (LDPE) may exceed 2 micron resolution in beam focus. In comparison, human hair ranges in diameter between 17 and 100 microns.

In the step 430, the thin-film anode layer is coated with a UV liquid that hardens under exposure to ultraviolet radiation. Specifically, the etched thin-film anode layer is coated on the metal side with the UV liquid. Then, in the step 440, the coating is exposed to UV radiation. Once an even and thin coating of the UV liquid is achieved, a pattern is prescribed by exposing only portions of the coating to UV radiation. Methods of limiting UV exposure to specific patterns of the thin-film layer may include rotating a drum whose surface consists of a mask which would allow for the transference of UV radiation except for the prescribed areas. The anode cell layer, coated with the UV activated liquid would be in contact with the drum's external side and rotated with the drum such that when the UV radiation source emanates from the center of the drum, radiation transfers through the mask to the external layer hardening the UV liquid. Unhardened liquid is then washed from the layer leaving a UV coating in the prescribed pattern. Other manufacturing processes may include using LDPE however, with a UV laser running at reduced power levels so that it renders the UV liquid cured. These methods can achieve micron level accuracy at very high speeds and allow for miniaturization of an electro-chemical time temperature indicator (eTTI).

A common cathode may reside adjacent to the electrochemical cells or run the length and width of all the cells. Since edge depletion is preferred, the bottom portion of the cells are coated with an insulating material where insulation from the electrolyte is desired and leaving openings where desired. Such openings then provide ingress for the electrolyte to deplete the anode horizontally from an edge.

Figure 5:
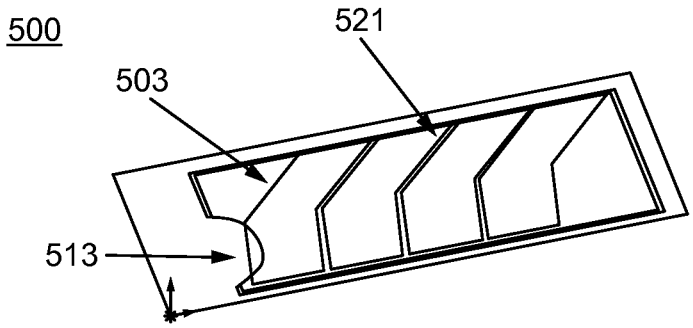
FIG. 5 illustrates an electrochemical timing cell in accordance with some embodiments.

For example, as shown within FIG. 5, the timing device 500 comprises an anode layer coupled with the cathode 510 and comprising a UV coating 519. The Al anode layer 503 comprises multiple sealed etch points 521 and an opening at an ingress point 513 to allow an electrolyte to deplete the anode 503 horizontally from an edge.

When the hardened UV coating contacts an area of the anode cell layer 503 which has had the Al etched off, a seal is created, limiting access/ingress to by the electrolyte once the device 500 is in operation. When the hardened UV coating 519 comes in contact with the Al coating, as opposed to areas where the Al has been etched off, an electrolyte "ingress" point 513 is created.

Figure 6:
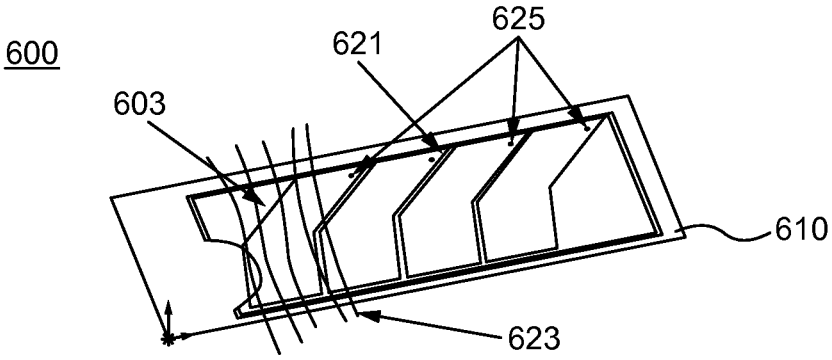
FIG. 6 illustrates an electrochemical timing cell in accordance with some embodiments.

Within a multi-cell configuration, the shape of each cell is important. As shown in FIG. 6, with a multi-cell configuration using edge depletion, anode 603 depletion migrates away from the cathode 610 with the anode material 603 closest to (electrically, with least resistance) cathode material 610 depleting first. To prevent the depleting anode material 603 severing electrical connectivity with the TDR 625 then cathode 610, the point of contact for the TDR is placed furthest from the depletion edge 623 of the depleting anode 603.

EXAMPLE 3

Timing Mechanism

With edge depletion a certain amount of time is required for anode material to deplete from a point "A", on a horizontal plane, to a point "B" on the same plane. The time it takes for depletion to travel this distance is usually referred to as the "timing mechanism" of the cell. With edge depletion, the internal resistance ($R_{ID}$) of the cell is partially dependent upon the distance from the leading edge (depletion edge) of the anode to the cathode. As depletion occurs this resistance becomes greater, as does the internal resistance. The current produced by the cell then decreases as depletion proceeds. Since, in some embodiments, the depletion rate relative to temperature is controlled by a temperature dependant material placed in series within the external electron return path which regulates current flow. Any internal fluctuation in current, not dependent upon temperature changes, e.g. fluctuation in current due to increasing resistance caused by the increase in distance between the anode and cathode, will render the timing mechanism inaccurate.

Figure 7:
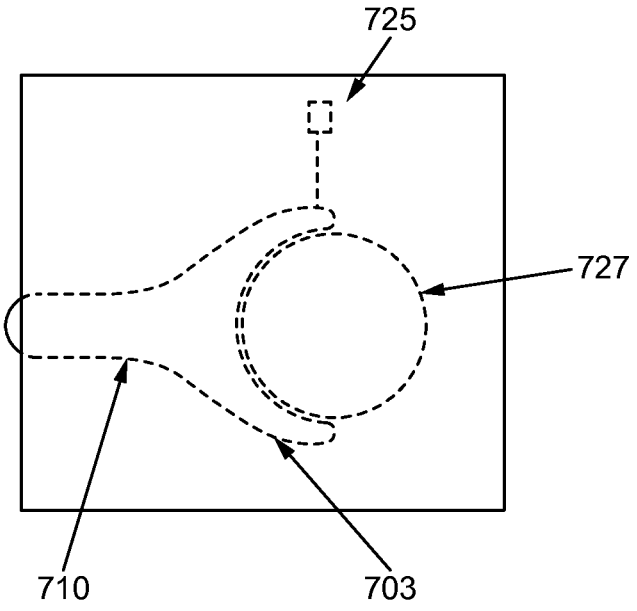
FIG. 7 illustrates an electrochemical timing device in accordance some embodiments.

In some embodiments, the $R_{ID}$ is mitigated by increasing the exposure of anode material to the electrolyte, by progressively increasing the size of the anode layer the further the depletion migrates away from the cathode. Since the maximum current capacity of the Galvanic cell will be achieved when the anode and cathode (plates) have approximately the same surface area, any reduction in plate size of one over the other will render a reduction in current flow. In this embodiment depletion begins with the size of one over the other will render a reduction in current flow. In this embodiment depletion begins with the plates being different sizes with the cathode being much larger than the anode and as $R_{ID}$ increases, tending to increase current flow. In this way the current within each cell does not change due to $R_{ID}$ and is therefore only changed by external temperature dependent material. FIG. 7 illustrates an electrochemical timing device in accordance some embodiments, such as described above.

As shown within FIG. 7, the timing mechanism 710 comprises an anode layer 703 that increases in size as it migrates away from the cathode. The TDR material 725 placed within the cell regulates the current flow. The anode layer 703 increases in size until it reaches a sudden visual change area 727, where a sudden visual change is seen as the timing mechanism 710 expires.

Figure 8:
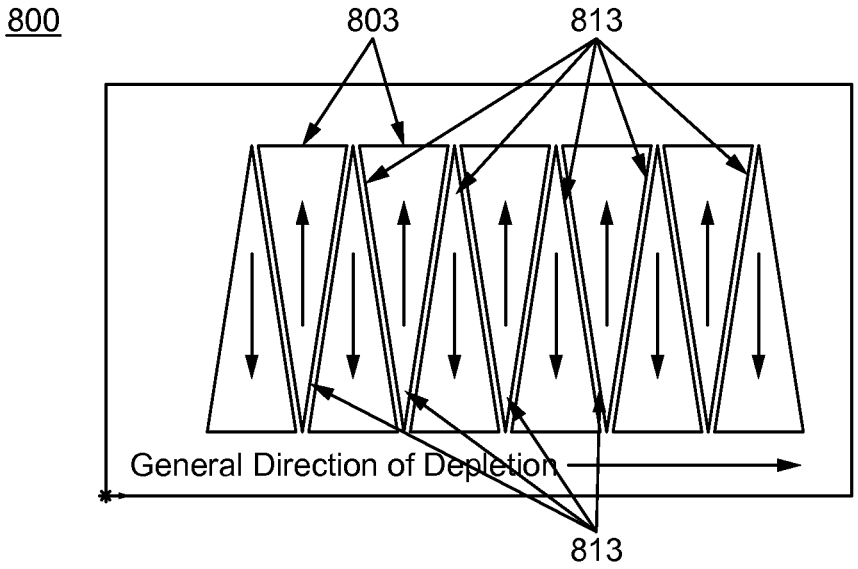
FIG. 8 illustrates an electrochemical timing cell in accordance with some embodiments.

In some multi-cell embodiments, the anode layer in each cell is configured with one or more wedge-shaped plates with ingress points located toward the smaller end of each plate. FIG. 8 illustrates a timing cell 800 comprising one or more anode plates 803 with one or more ingress points 813 located toward the smaller end of each anode plate 803. The anode plates 803 are in opposite configurations such that the completion of the depletion of one cell 800 will lead to an ingress point 813 of an adjacent cell. In a multi-cell configuration, each cell is electrically isolated from the neighboring cells.

EXAMPLE 4

TDR Regulation

Accuracy tolerance and repeatability in performance of timing systems/labels of this type is important. One of the factors which contributes to such accuracy is resistance imposed by the TDR placed within the electron return path between a cathode layer and an anode layer. Highly accurate means exist for mixing compounds to make up the TDR. Measuring and placing such compounds within timing devices may prove more challenging though with the existing methods of application such as ink jet and other types of printing. Since resistances associated with the TDR are comprised of parallel resistance values of a column of TDR material, diameter and shape of a printed TDR would need to be held to a tighter tolerance than what might be available through ink jet printing. One embodiment includes a means to mitigate unacceptable tolerances in application of TDR material. Within the center layer which lays between a top lens layer and a bottom base layer, a series of holes are placed. This example is illustrated in FIG. 9, which illustrates a TDR sequence.

Figure 9:
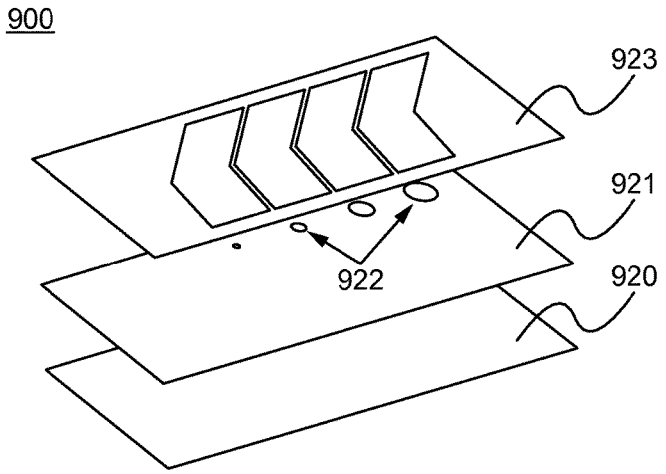
FIG. 9 illustrates an exploded view of an electrochemical cell incorporating a temperature dependent resistor (TDR) in accordance with some embodiments.

As shown within FIG. 9, one or more TDR holes 922 are placed within a center layer 921 between a top lens layer 923 and a bottom base layer 920 of an electrochemical cell 900. As described above, in some embodiments, each eCell 900 comprises an anode layer and a cathode layer in contact with an electrolyte for indicating a passage of a period of time. Such holes 922 are punched or die cut into the middle layer 921 during manufacturing and are thus highly accurate in size and shape. In some embodiments, there exists one hole lateral to each eCell 900. With multiple cell devices there exists multiple holes. The size of each hole may be the same, however if different depletion rates or different temperature profiles are required for different eCells, then different TDR material with resistance values may be required for the device. However, having to mix various samples of TDR material may prove unnecessarily costly. Instead the holes are manufactured to different sizes or diameters and the same TDR material is simply spread into each hole during the manufacturing process. Since the holes have increasing or decreasing cross sections, and the total resistance of each TDR conforms to the parallel resistance value of the columns, the total resistance value of each TDR will correspond to the size of the hole.

EXAMPLE 5

General Activation

In the past electro-chemical color changing labels have been activated by introducing an electrolyte into a compartment containing the cathode and the anode. Once the electrolyte comes into contact with the electrodes, a galvanic action is initiated. Labels may need to be held in inventory or on the shelf for some period of time prior to activation. Problems regarding excessive costs may arise from having to manufacture holding reservoirs, which prevent the electrolytes from coming in contact with the electrodes until activation. Such reservoirs need to contain the electrolyte for the period of time on the shelf and be able to manipulated in such a way as to release the electrolyte upon activation. Typically, the method of activation for such reservoirs is mechanical rupture. In some embodiments, UV radiation is used to degrade the material used for the containment of the reservoir ending in rupture.

Figure 10:
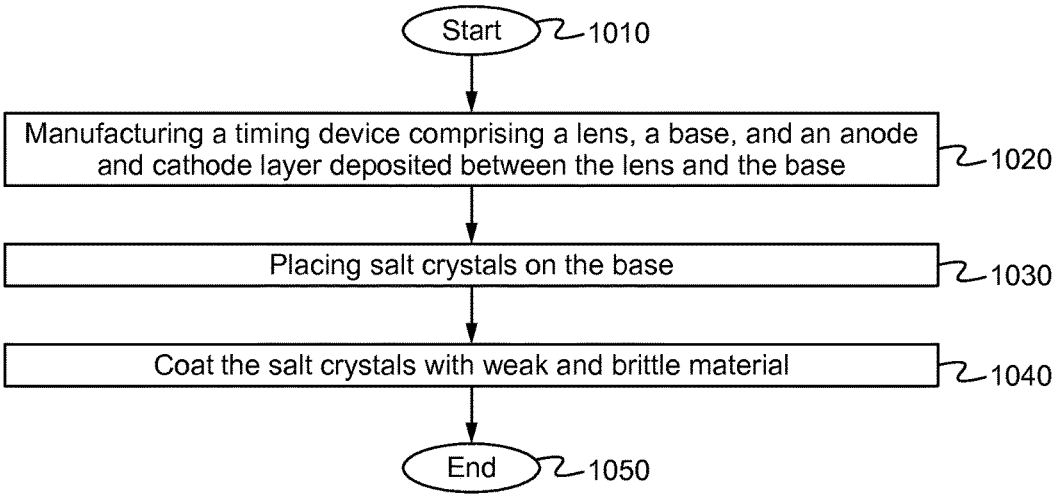
FIG. 10 illustrates a method of manufacturing an electrochemical timing device in accordance with some embodiments.

FIG. 10 illustrates a method of manufacturing an electrochemical timing device in accordance with some embodiments. The method begins in the step 1010. In the step 1020, a timing device comprising a lens, a base and an anode layer and a cathode layer is deposited between the lens and the base. In the step 1030, a plurality of salt crystals are placed on the base and in the step 1040 the salt crystals are coated with a weak and brittle material. The method ends in the step 1050.

Figure 11:
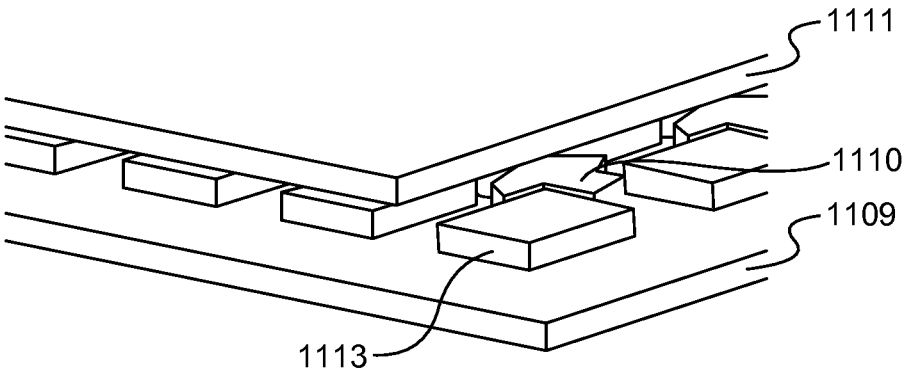
FIG. 11 illustrates an activatable electrochemical timing device in accordance with some embodiments.

During manufacturing the timing device is flooded with an ion-free solution. This ion-free solution will not interact chemically or electro-chemically with the electrodes. As a result, a shelf life of the label may remain indefinite. As described above, the salt crystals are placed onto the base layer which is positioned within the flooded compartment and coated with the weak and brittle material. In some embodiments, the salt crystals are placed within a wafer coated with a weak and brittle material and which resides within the flooded compartment. Activation occurs by bending the wafer or coated salt until its weak and coated encapsulate has ruptured which allows the ion-free solution to come into contact with and dissolve the exposed salt. The ion-free solution becomes ion rich and the cell becomes activated. FIG. 11 illustrates the plurality of salt crystals 1110 placed within the wafers 1113 on the base 1109 and coated with the weak and brittle thin coating 1111.

EXAMPLE 6

Freeze/Thaw, Excursion

Some applications of time temperature indicators require providing more information than simple time and temperature. They may, for example, require recording of extraordinary temperature readings known as excursions which may occur within the timing period. Temperature points of interested excursions are defined and designed into the devices in advance. One important temperature point is termed "freeze/thaw" and occurs at zero degrees centigrade. In the past electro-chemical time temperature indicators (eTTI) labels utilized the expansion properties of freezing water to activate a cell. A droplet of water is encapsulated and upon freezing, expands and ruptures its capsule. This in turn causes the rupture of an electrolyte capsule or dissolves a salt resulting in the activation of the excursion cell. Other temperature points are of interest for recording excursions as well.

Products, perishable or pharmaceuticals may have critical "not-to-exceed" temperatures which must be monitored. In such cases, materials with specific melting points are used to activate an excursion cell. Polyethelye Glycol (PEG) for instance, may exist with different molecular lengths. Progressively longer chain lengths yield properties with progressively higher viscosities even to the melting point of a solid. PEG has been used as an electrolyte itself. When the solid form is used, it must be melted before it becomes an electrolyte suitable for the eTTI to become activated. Since it melts at a specific temperature it is used as the means for activating an excursion cell. Materials including PEG are utilized which have varying melting points to activate excursion cells at different temperature points in this way.

Figure 12:
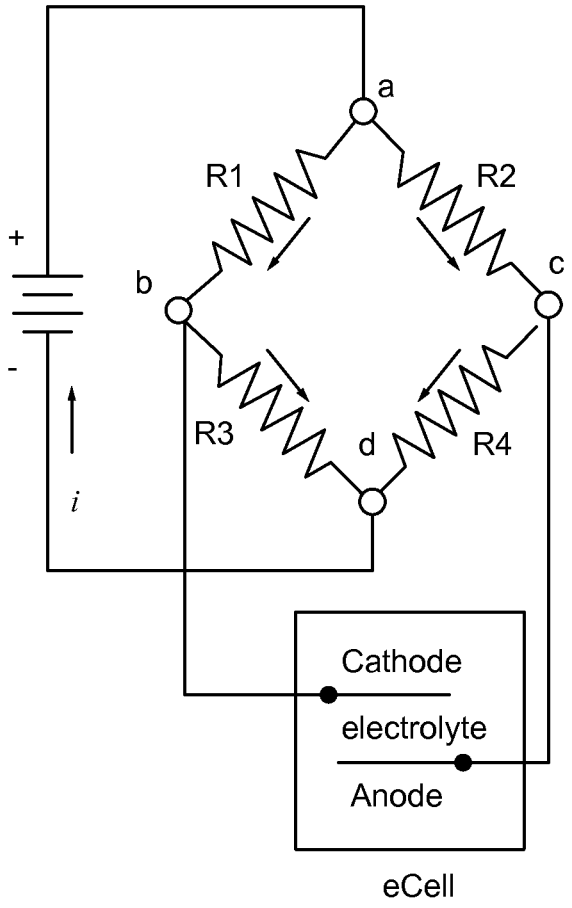
FIG. 12 illustrates a Wheatstone Bridge configured for activating an electrochemical cell in accordance with some embodiments.

In other embodiments, excursion cell activation may occur electronically by reversing a direction of the electrical current. In this embodiment, an electronic circuit known as a Wheatstone Bridge (FIG. 12) is utilized whereby the pins of four resistors are connected to one another. In this embodiment, the values of two of the resistors are matched and two of the resistors are not. The one or two resistors that are not matched in value consist of TDR material with different temperature profiles however within the same range. The temperature profile of each of these resistors can be charted on a graph with each having a different slope. The point at which the two slopes intersect will represent a temperature whereby the direction of current within the lateral portion of the Wheatstone Bridge changes by 180 degrees. It is this change of direction in current, upon reaching or exceeding a specific temperature "excursion" point that the excursion cell can be activated.

In another embodiment, three of the resistors are matched and only one resistor comprises TDR material and in such case the polarity changes when the TDR value becomes greater or less than the opposing resistor. An unlimited number of temperature excursion points can be defined in this way, activating an unlimited number of excursion cells at temperatures above or below the excursion point. During manufacturing, the application of TDRs within the eTTIs is simple and straightforward as compared to fabricating and inserting capsules of water and simpler than inventorying and inserting PEG of varying molecular chains. In addition, this electronic method lends itself to miniaturization more readily than the others.

Anode depletion as a result of each excursion can also be suspended with any of the methods, as described above. Since the anode is conductive it can also be used as an electrical trace or path for galvanic activities related to an excursion. Eliminating any portion of such a trace will suspend galvanic activities associated with the excursion. Such a trace can be eliminated by a depletion of the main anode material.

EXAMPLE 7

Sequential Cell Activation

Within devices having multiple cells it may be desirable to initiate activation of cells sequentially where the completion of one cell initiates activation of an adjacent cell, such as described in relation to FIG. 8. In some embodiments, an electrolyte is prevented from migrating to subsequent cells because physical barriers exist which prevent such migration. One such physical barrier is the thin-film Al anode layer associated with a previous eCell of the multiple cells. Once the Al anode layer associated with the previous eCell depletes, the physical barrier it represented is removed thus allowing for a migration of the electrolyte to the adjacent eCell. In this way multiple cells can be ganged together and whose anode layers sequentially deplete.

In another embodiment, multiple eCells are allowed to come into contact with a common electrolyte where each subsequent cell is subjected to an electrical charge of reversed polarity which is equal and opposite from that which the eCell is producing itself. In such a case, the eCell is held in suspense preventing depletion of the anode layer. Once an electrical connection equal and opposite to the charge is broken anode depletion can occur and the eCell becomes active. In such an embodiment, the equal and opposite charge is created by eCells housed within the same device. In some embodiments, the polarity is reversed using a Wheatstone Bridge, such as described above.

EXAMPLE 8

Sudden Change, Single Cell

As described above, with edge depletion a certain amount of time is required for anode material to deplete from a point "A", on a horizontal plane, to a point "B" on the same plane. The time it takes for depletion to travel this distance is usually used as the "timing mechanism" of the cell. Of course, this time is also dependent upon the resistance values involved with the circuit both internally and externally. Internal resistances, involving an electrolyte can be engineered at the time of manufacture. External resistance properties with regards to the series resistor, typically, TDR can be engineered as well. In some embodiments, a timing mechanism can be engineered to span months or longer. Within the same device some cells may be required to change suddenly over the course of hours. This poses a challenge in that sudden depletion may be desired within a cell utilizing slow depletion as its timing mechanism and while using the same electrolyte, anode material and common cathode. This scenario may occur when a single cell is utilized having a longer timing mechanism but with a sudden visual change at the end of the timing period.

One method of accomplishing a more rapid depletion rate is to include multiple electrolyte ingress points into the same cell within the area designed to change suddenly, thus initiating depletion at multiple points.

In another embodiment, internal resistance is reduced in the area desired to change suddenly. This may be accomplished by exposing anode material to cathode material, which is closer in proximity to the anode.

In a further embodiment, the electrolyte is allowed to enter a previously dry compartment of the cell, thus allowing the anode and cathode to be in electrical contact. Yet still electrolyte may be allowed to enter a wet, however ion free, compartment allowing the anode and cathode to become in electrical contact.

Another embodiment includes two eCells electrically opposed to each other with opposite polarities and when such opposition is reversed, depletion becomes electrically supported with the desired depletion becoming accelerated. The galvanic action of one cell accelerates the depletion of another cell. Such a method may use a Wheatstone Bridge, such as described above, whereby the polarity of the cell is reversed due to an intentionally caused "imbalance" of resistances within the bridge.

EXAMPLE 9

RFID, Tag, Antenna Tuning, Capacitive Sensing, Bar Code, QR Code, Machine Readable Optical Label Radio Frequency Identification Devices (RFID) typically transmit binary sets of numbers upon activation. This set of numbers is usually programmed into the chip in advance. Some devices contain their own power supply and some acquire power externally from absorption of radio frequency radiation by an exposed antenna. Antennas of these devices are typically tuned to resonate only to a narrow range of carrier frequencies that are centered on the designated RFID systems frequency. Data contained within the device intended to be transmitted is usually limited to that which was programmed initially, and does not change Such devices are typically unable to sense changes in external variables like temperature, radiation, humidity, etc.

Most metals will shield radio frequency (RF) radiation. In some embodiments, anode material is composed of metal, not limited to metallic aluminum. Aluminum film is used in RF shielding of sensitive electronics in many industries and fields. Since an intact anode within an eLabel or eCell consists of RF shielding material, RF sensitive materials or components can be shielded from RF radiation. Shielding can remain intact until the anode becomes depleted to the point that RF radiation is no longer shielded.

In one embodiment, RFID antennas are placed behind an undepleted anode such that the Al, or other metal anode shields the antenna from RF radiation. As the anode depletes, RF shielding diminishes and it allows RF radiation to come into contact with the antenna, or portion of the antenna which is no longer shielded, thus activating and reading a passive RFID antenna and/or reading an active RFID antenna. One or more antennas may be placed in this shielded position such that when the anode depletion exposes the antennas they become active. In such a case, the RFID antenna may be electrically isolated from the anode layer and from any galvanic action. In this way, a third dimension may be added to the RFID because one or multiple RFIDs become active as a function of some external variable such as temperature, radiation, or humidity, etc. For example, a human inspecting a series of products may use an RFID reader to determine that product XX has exceeded a maximum temperature limit of YY, or that product ZZ is 50% into its degradation cycle.

In another embodiment, a depleting anode may be used to expose increasing portions of an RFID antenna such that it becomes tuned to resonate to a different range of carrier frequencies such that the change in carrier frequency becomes representative of the external variable being sensed by the eLabel device.

In yet another embodiment, a depleting anode will deplete an electrical trace such that the anode material becomes orphaned or electrically decoupled. When such orphaned anode material overlays the cathode material a capacitor with a specific value may remain. Since capacitors are often used in tuning electrical circuits, including some RFID antennas the capacitor created by a depleting anode can be used as components in circuits that generate data representative of external variables such as temperature, humidity, or radiation, etc.

In some embodiments, a depleting anode may expose a two-dimensional or three-dimensional bar code, which can then be read by an electronic bar-code reader.

The depleting anode may reveal a change in color as well as an RFID antenna. Any color layer may consist of a non-shielding material. In this way the device may reveal a color change upon anode depletion as well as a radio frequency response from an RFID antenna as time and or other variable progress. In such case, for example, a human inspecting a series of products may wish to electronically read the RFID tags which visually indicate a change in an external variable. This method may save incalculable time and cost with such data acquisition.

Figure 13A:
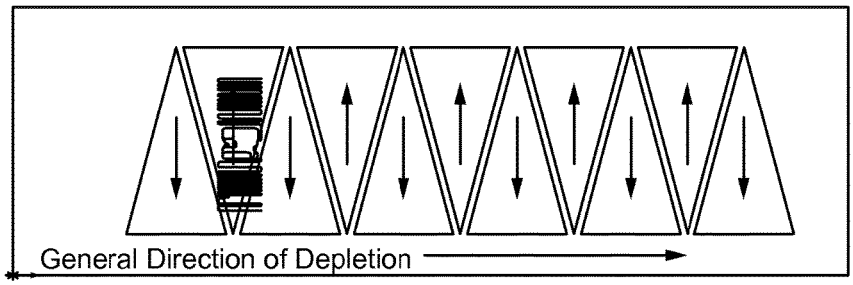
FIGS. 13A and 13B illustrate an electrochemical timing cell comprising an RFID antenna in accordance with some embodiments.
Figure 13B:
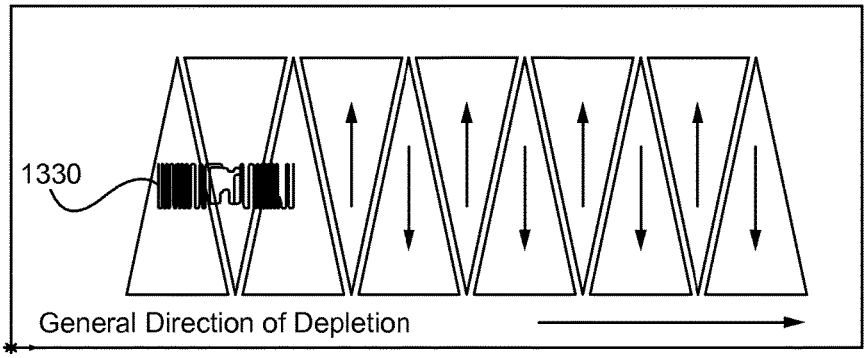

In further embodiments, a top shielding material is chemically dissolved revealing an RFID or its antenna. For example, as shown in FIGS. 13A and 13B, an RFID antenna 1330 is deposited under a shielding material in a timing device such as depicted in FIG. 8. As the timing device 1300 is depleted in the direction of the arrow, the RFID antenna 1330 is unshielded to radio frequency such that it can be read. In some embodiments, a shielding material or metal utilizes a localized galvanic action, with or without generating a potential, to deplete or oxidize the material to expose and/or unshield the RFID antenna.

In yet another embodiment, an RFID tag is deposited directly onto a thin-film metallic coating of dissimilar material than the antenna itself and of a material which is anodic relative to the material making up the antenna. In such a case the materials are in electrical contact with one another. Once the two dissimilar materials come in contact with a common electrolyte, galvanic action initiates with the anodic material "anode" depleting away from the cathodic "cathode" "antenna" material. Since both the anode and the cathode material are conductive and in electrical contact with each other and receptive to RF radiation, the antenna is not electrically presented independently and therefore will not allow for prescribed absorption of RF radiation, or prescribed transmission of data from the RFID. Once electrical contact is severed between the anode "thin-film" coating and the cathode "RFID antenna" prescribed RF radiation absorption takes place as well as prescribed transmission of data. Depletion of the anode occurs rapidly immediately adjacent to the cathode severing electrical contact. Numerous methods and processes exist for deposition of possible cathode material onto thin-film coated anode material which are not limited to evaporative techniques, sputter, silk screen, direct printing and photo lithography.

Figure 14:
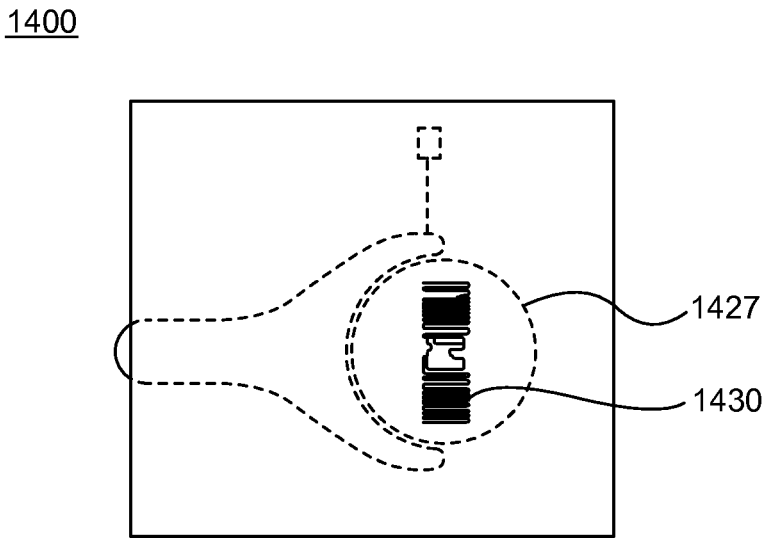
FIG. 14 illustrates an electrochemical timing cell comprising an RFID antenna in accordance with some embodiments.

When such an embodiment is combined with a timing mechanism such as shown in FIG. 7, a duration of time can be digitally read with an RFID reader. As shown within FIG. 14, the RFID tag 1430 is unshielded in the sudden visual change area 1427 as the timing mechanism 1400 expires. When combined with the time and temperature mechanism (TTI), as described above, the TTI can be digitally read with the RFID reader. In the same way, exposure to solar radiation, atomic radiation, humidity, vibration and any other event, electrically measurable, can be read digitally the RFID reader. This may prove exceptionally useful for reading temperature excursion which may occur along a timeline.

Figure 15:
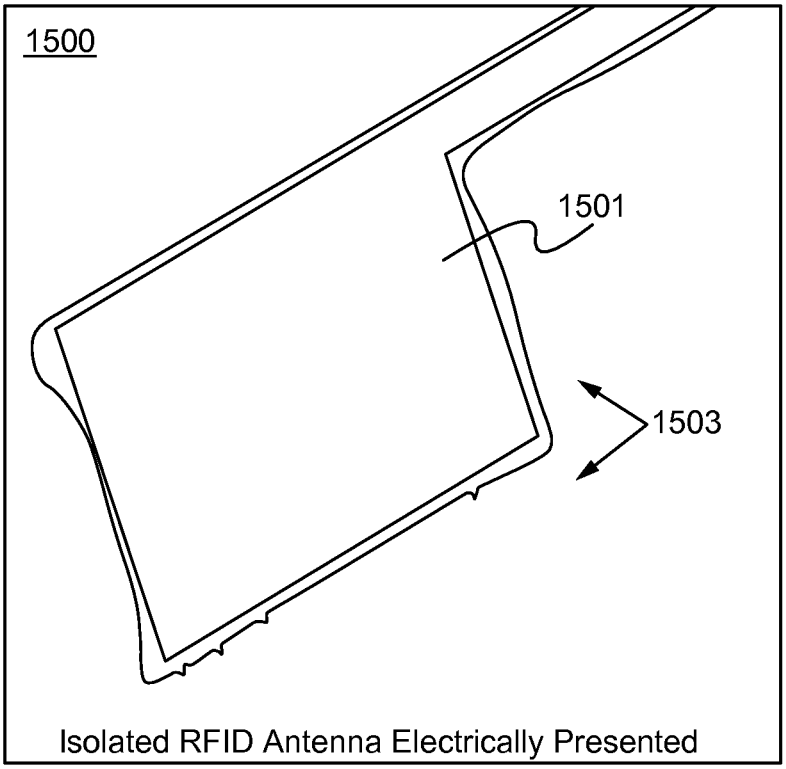
FIG. 15 illustrates a temperature dependent timing device in accordance with some embodiments.

In another embodiment, temperature excursions alone, without the element of time, can be detected and logged. FIG. 15 illustrates a temperature dependent timing device in accordance with some embodiments. The timing device 1500 comprises an RFID antenna 1501 comprising a cathode material such as a Copper (Cu) material deposited onto a thin-film anode material 1503. The cathode material has come into contact with a solid substance, which has a higher melting point and which when melted becomes conductive and/or an electrolyte. This is an electrolyte which is solidified due to lower temperatures. After reaching a predetermined, higher temperature, the solid substance melts and becomes an active electrolyte in contact with the cathode material and the anode material 1503. Galvanic action is initiated in the location where the two dissimilar materials are in closest proximity to each other. The RFID antenna 1501 becomes active, electrically isolated from the anode material 1503, and therefore is able to respond and transmit to an RFID reader.

In some embodiments, remaining anode material is electrically connected with independent cathode material resulting in continued depletion of the anode material, even after the cathode RFID antenna has been electrically decoupled from the anode material. In some embodiments, an RFID temperature excursion indicator uses the cathode as a ground plane for the RFID antenna.

Figure 16:
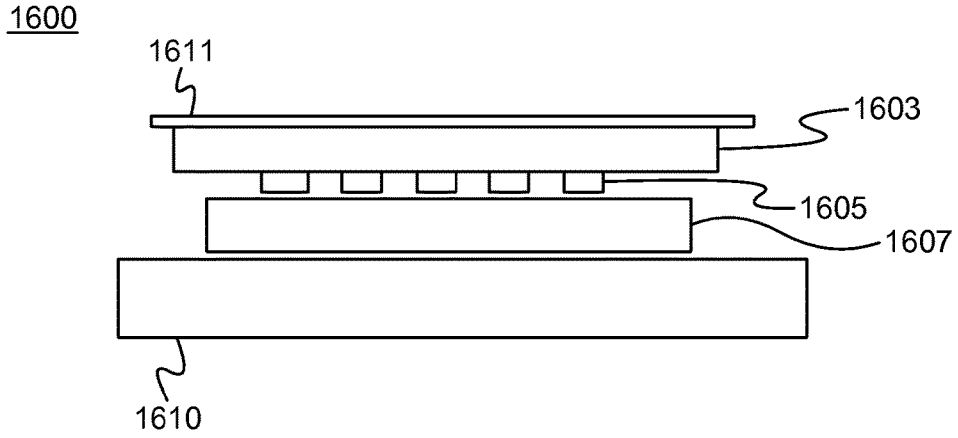
FIG. 16 illustrates a temperature excursion indicator in accordance with some embodiments.

In further embodiment, such as shown in FIG. 16, an RFID temperature excursion indicator uses an RFID antenna as a cathode. As shown within FIG. 16, the temperature excursion indicator 1600 comprises a lens 1611, a base 1610 and a thin-film anode 1603 and a cathode 1605 between the lens 1611 and the base 1610. As described above, the cathode 1605 comprises an RFID antenna. As further shown within FIG. 16, the indicator 1600 comprises a solidified electrolyte 1607. When the indicator 1600 reaches a predetermined, higher temperature, the solidified electrolyte 1607 melts and becomes an active electrolyte in contact with the cathode material 1605 and the anode material 1603.

Figure 17:
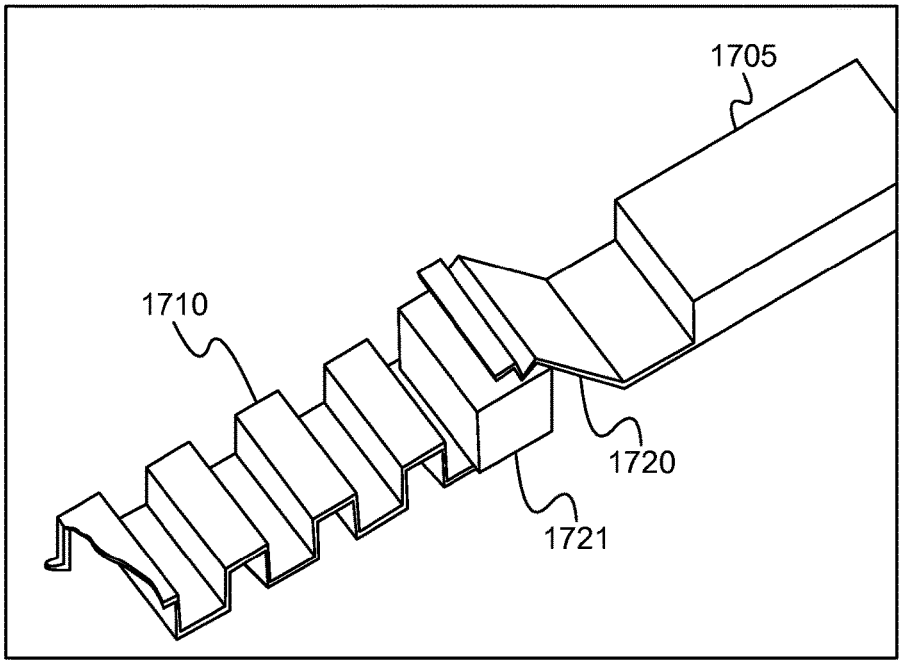
FIG. 17 illustrates an activatable RFID antenna in accordance with some embodiments.

In a further embodiment, such as shown in FIG. 17, an RFID chip 1705 is electrically decoupled from its antenna 1710. A switch 1720 is placed in series with the RFID antenna 1710 which is spring loaded such that it would tend to remain closed. However, during the manufacturing process or prior to operation, a low melting point substance 1721 is placed between the electrodes of the switch, causing it to remain open. In such a condition the RFID chip 1705 will not be able to receive/transmit RF or data, in a passive system or transmit data in an active system. Since no current is able to flow through the antenna 1710, due to the open circuit configuration, no reception or transmission is capable. However, upon reaching the critical temperature, at which the low melting point substance is softened or actually melts, the switch contacts close, thus allowing continuity of the circuit. Current is then capable of flowing through the antenna and the RFID then becomes active and is able to receive RF and transmit data.

In some embodiments, the low melting point substance 1721 is used as the temperature activated switch to couple and decouple the RFID antenna. For example, one embodiment uses a substance which is normally non-conductive, electrically open, which has a salt added to it. When in the solid state the salt is crystallized and the substance is non-conductive. When the substance melts, the solid dissolves and the liquid substance becomes ionized and therefore conducts and is able to pass current. Other methods may include using acids, bases or ionic liquids as the substance. In some embodiments, a low melting point metallic substance is used such that the switch is normally closed but becomes electrically open once the metallic substance melts. A temperature activated switch can be used to couple and/or decouple an antenna or multiple antennas from a RFID tag or RFID tags and may also modify a pattern of the antenna to modify its response frequency. In such case, exposure to numerous temperature events can be recorded.

In further embodiments, contact closure of a switch is accomplished by incorporating the expansion properties vs. the temperature properties of a material, such that when the temperature increases, the material expands. As the material expands, it physically closes a normally open switch in series with the RFID antenna. Once the switch is closed, the RFID becomes active. In some embodiments, the switch is momentary and is held closed for as long as the critical temperature remains. In alternative embodiments, the switch becomes latched and will not decouple after, no matter the temperature excursion. In further embodiments, as the expanding material expands, it contacts multiple electrical contact points with each contact point leading to a different antenna and/or an expansion of the same antenna. In this way the same RFID may transmit multiple different frequencies and at different temperature points.

In some embodiments, the expanding material comprises a non-conductive material with a conductive trace and attached contact point. Alternatively, in some embodiments, the expanding material comprises a conducting metal.

Figure 18A:
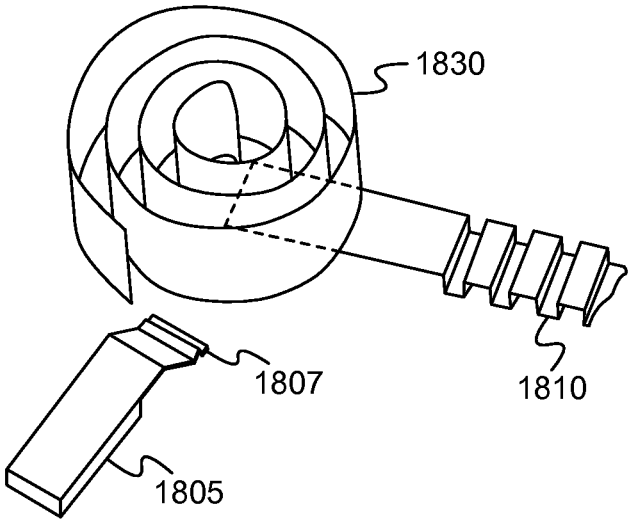
FIGS. 18A and 18B illustrate an activatable RFID antenna in accordance with some embodiments.
Figure 18B:
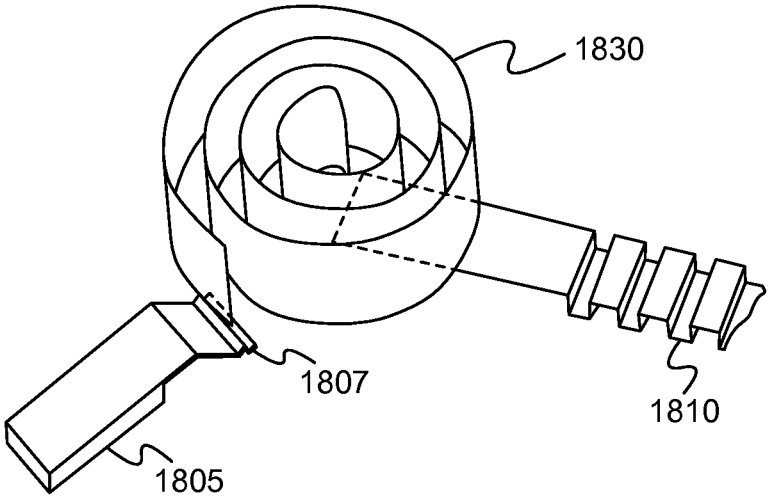

In some embodiments, as shown within FIGS. 18A and 18B, the expanding material comprises a metal spring 1830 that expands with an increase in temperature and retracts with a decrease in temperature. As shown in FIG. 18A, as the spring 1830 expands, it touches the switch contacts 1807 of the RFID chip 1807 and completes the circuit. Current is then capable of flowing through the antenna 1810 and the RFID then becomes active and is able to receive RF and transmit data. As shown within FIG. 18B, when the temperature decreases, the spring 1830 retracts such that it no longer touches the switch contacts 1807. In this position, current does not flow through the antenna 1810 and the RFID is not active. Thus, the RFID cannot receive and/or transmit data.

Figure 19:
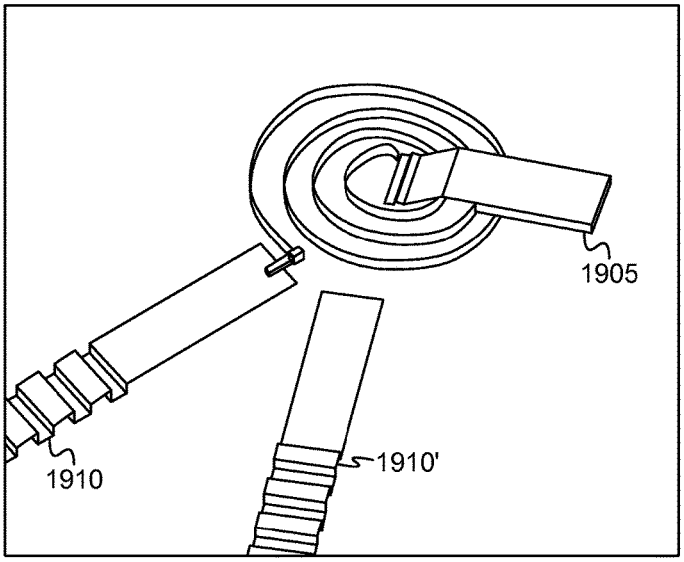
FIG. 19 illustrates an activatable RFID antenna in accordance with some embodiments.

In some embodiments, one or multiple temperature points are detected by the same RFID by using multiple tuned to different center frequencies. In some embodiments, such as shown within FIG. 19, multiple RFID chips may be used in conjunction with a single antenna, with each RFID chip containing different data. Particularly, the temperature points may indicate boiling points, freezing points or almost any other point above or below zero degrees. In this manner freeze alerts, or any other temperature alert may be incorporated with the RFID tag.

Figure 20:
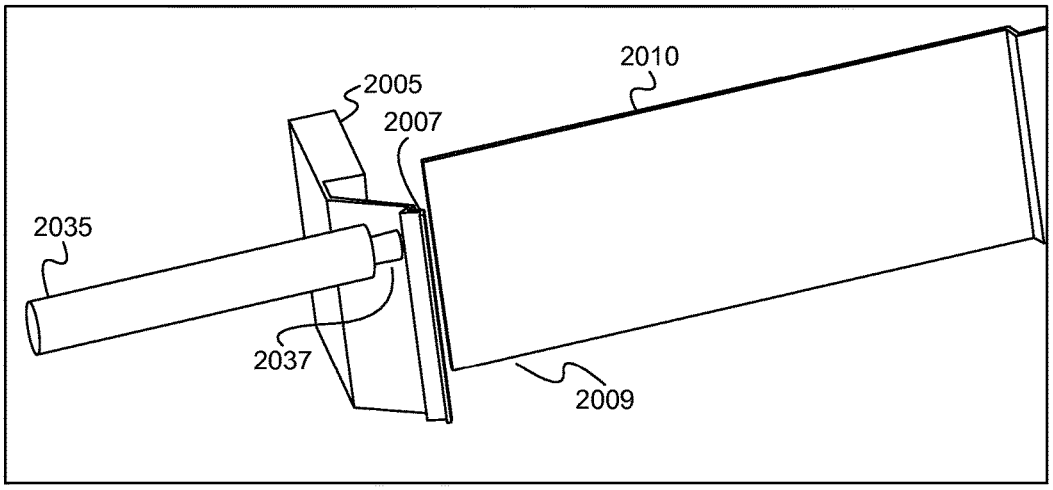
FIG. 20 illustrates an activatable RFID antenna in accordance with some embodiments.

In some embodiments, the expanding qualities of a freezing liquid are used to close a switch completing a circuit in series with an RFID antenna. In this way a freeze alter indicator may be incorporated with an RFID tag. As shown within FIG. 20, when an expanding freeze tube 2035 freezes, a plunger 2037 is pushed from the tube 2035 to place the switch contacts 2007 in contact with the antenna contacts 2009 of the RFID antenna 2010. As the ram pushes the switch contacts 2007 in contact with the antenna contacts 2009, the RFID circuit is completed. Current is then capable of flowing through the antenna 2010 and the RFID then becomes active and is able to receive RF and transmit data from the RFID chip 2005. In some embodiments, water is placed within the tube 2035 and sealed at one end. The plunger 2037 is incorporated with the tube 2035 and inserted so that it contacts the water. The plunger 2037 extends from the tube 2035 as pressure is applied to it. The plunger 2037 only moves in one direction because of the non-compressible properties of the water.

Upon freezing, the water solidifies and expands and as it does it pushes the plunger 2037 out of the tube 2035. As the plunger 2037 is pushed from the tube 2035, the end of the plunger 2037 pushes on the open switch which is connected in series with the RFID antenna 2010. Once the expanding water/ice expands far enough, the switch is closed completing the circuit and the RFID becomes active. The RFID remains active until the water melts and the plunger 2037 is retracted into the tube 2035. When configured with a latch, the switch will stayed in the closed position. Alternatively, when configured without a latch, the switch will return to the open configuration. In this manner, the RFID may alarm momentarily of a freezing situation or latch permanently indicating that the RFID tag has experienced a freezing condition.

Figure 21:
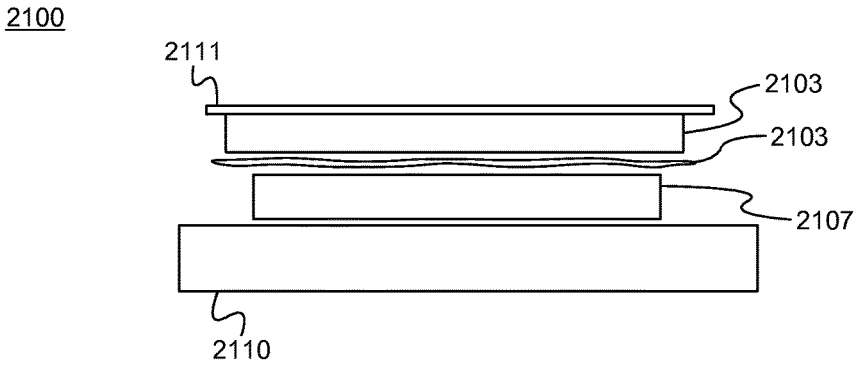
FIG. 21 illustrates an electrochemical temperature excursion indicator in accordance with some embodiment.

In some embodiments, as depicted in FIG. 21, a temperature excursion indicator consists of an electro-chemical visual, temperature-excursion indicator with an anode and a cathode layer. The temperature excursion indicator 2100 comprises a clear lens layer 2111, an anode layer 2013, a cathode layer 2105, and a solidified electrolyte 2107 deposited on a base 2110. The anode layer 2013 is electrically coupled with the cathode layer 2105 and both come into contact with the common electrolyte 2107. The electrolyte 2107 is solid (inactive) at lower temperatures and liquid (active) at higher temperatures. The melting point of the electrolyte becomes the excursion temperature and when active, the anode layer 2103 undergoes oxidation and thereby depletes exposing a color, text, or graphic imprinted on the underlying base layer 2110.

In operation, the timing devices and/or the temperature indicators as described above have many advantages. As described above sensing materials of varying types are able to be incorporated within the timing device to indicate a total elapsed time including a time of exposure to a temperature and an environmental attribute. Additionally, the indicators may consist of singular and multiple depletion cells. Additionally, each indicator may be configured with an applicator to be used as a label and/or attached to an additional object. Further, each indicator may be implemented with one or multiple RFID tags tuned to different center frequencies. The RFID tags are activatable to indicate an exposure of the device to an attribute and for a defined period of time. The above devices have applications for marking when any number of different events need to take place and/or for timing the duration of any number of different events. For example, the timing device has applications for indicating when perishable materials have expired and need to be thrown out, indicating the age of inventory and managing when the inventory needs to be rotated, tracking a deadline and a host of other time and/or temperature dependent events. As such, the indicating devices and systems as described herein have many advantages.

The present invention has been described in terms of specific embodiments incorporating details to facilitate the understanding of the principles of construction and operation of the invention. As such, references, herein, to specific embodiments and details thereof are not intended to limit the scope of the claims appended hereto. It will be apparent to those skilled in the art that modifications can be made in the embodiments chosen for illustration without departing from the spirit and scope of the invention.

I claim:

1. An electrochemical timing device comprising:

a. a lens for viewing a expiration of the timing device, b. a base, c. a cathode layer coupled to the lens and the base;

d. an anode layer comprising a plurality of coated non-metalized sections and coupled to the lens and the base; and e. an electrolyte, wherein the timing device is activated when the electrolyte comes into contact with the anode layer and the cathode layer, and wherein the electrolyte is prevented from migrating past an edge of depletion by the coated non-metalized sections of the anode layer after the timing device is activated and wherein an RFID antenna is unshielded as the timing device expires, and wherein the electrolyte comprises an unconductive substance that becomes conductive when the electrolyte liquifies, and wherein the RFID antenna conveys additional data.

2. The electrochemical timing device of claim 1, wherein the anode layer is uniformly depleted from the leading edge across the anode layer.

3. The electrochemical timing device of claim 1, wherein the electrolyte liquefies at a predefined temperature activating the device.

4. The electrochemical timing device of claim 1, wherein one or more of a color, text, and a graphic is uncovered as the timing expires.

5. The electrochemical timing device of claim 1, wherein the RFID antenna comprises temperature excursion information of the timing device.

6. The electrochemical timing device of claim 1, comprising one or more temperature dependent regulators for increasing an accuracy of the device.

7. The electrochemical timing device of claim 1, wherein the anode layer comprises one or more wedge-shaped plates with an electrolyte ingress point at a smaller end of each plate.

8. An electrochemical timing system comprising:

a. a lens;

b. a base;

c. a plurality of electrically segregated anode cells deposited between the lens and the base wherein the plurality of segregated anode cells each comprise a wedge-shaped plate with an electrolyte ingress point at a smaller end of each plate; and d. a common cathode layer which covers an entire surface area of the plurality of anode cells.

9. The electrochemical timing system of claim 8, wherein cell segregation is accomplished by etching a sheet of anode material to separate the anode material into the plurality anode cells.

10. The electrochemical timing system of claim 8, wherein the timing system is activated by introducing a quantity of electrolyte into the system.

11. The electrochemical timing system of claim 10, wherein the plurality of anode cells are sealed in a manner to allow ingress by an electrolyte at a discrete point.

12. The electrochemical timing system of claim 8, wherein each of the plurality of anode cells comprises a temperature dependent resistor.

13. The electrochemical timing system of claim 8, wherein the plurality of anode cells are coated with a UV activated liquid.

14. The electrochemical timing system of claim 8, wherein the plurality of anode cells are sequentially activated.

15. An electrochemical timing system comprising:

a. an anode layer;

b. a cathode layer;

c. a quantity of electrolyte, wherein when the electrolyte contacts the anode layer and the cathode layer the timing system is activated and the anode layer begins to deplete in a direction away from an edge of depletion; and d. an RFID tag underlying the anode layer, wherein an RFID antenna of the RFID tag is electrically decoupled from the RFID tag and wherein a temperature activated switch of the RFID tag changes state to open or closed when the timing system reaches a defined temperature causing the RFID tag to become active.

16. The electrochemical timing system of claim 15, wherein the RFID antenna is unshielded and becomes readable as the anode layer is depleted.

17. The electrochemical timing system of claim 15, wherein the timing system is configured to indicate a temperature excursion.

18. The electrochemical timing system of claim 15, wherein the electrolyte comprises an unactive solid state electrolyte that liquefies at a predefined temperature to become active and activate the device.

19. The electrochemical timing system of claim 15, wherein the temperature activated switch comprises a low melting point substance.

20. The electrochemical timing system of claim 15, wherein the low melting point substance is non-conductive when solid and conductive when in a liquid state.

21. The electrochemical timing system of claim 15, wherein the low melting point substance is conductive when solid and non-conductive when in a liquid state.

22. The electrochemical timing system of claim 15, wherein the switch comprises a low melting point substance which upon melting contacts multiple electrical contact points throughout the timing system.

23. A timing device comprising:

a. an RFID tag electrically decoupled from an antenna of the RFID tag; and b. a temperature activated switch coupled to the RFID tag, wherein the switch changes state to open or closed when the timing device reaches or vacates a defined temperature and causes the RFID tag to become active or inactive such that the RFID tag is able to receive and transmit RF data or stops receiving and transmitting data, wherein the temperature activated switch comprises a low melting point substance that is non-conductive when solid and conductive when in a liquid state.

24. The timing device of claim 23, wherein the temperature activated switch relies upon thermal expansion or retraction properties of materials within the switch.

25. The timing device of claim 23, wherein the temperature activated switch contacts increasing multiples of RFID antenna with increasing temperatures.

26. The timing device of claim 23, wherein the temperature activated switch contacts decreasing multiples of RFID antenna with decreasing temperatures.

27. The timing device of claim 23, wherein the temperature activated switch utilizes thermal expansion properties of freezing fluids to open the switch.

28. The timing device of claim 23, wherein the temperature activated switch utilizes thermal retraction properties of freezing fluids to close the switch.

29. An electrochemical timing system comprising:

a. an RFID tag; and b. an RFID antenna of the RFID tag, wherein the RFID antenna is electrically decoupled from the RFID tag and wherein a temperature activated switch of the RFID tag changes state to open or closed when the timing system reaches a defined temperature causing the RFID tag to become active, and wherein the RFID antenna transmits temperature excursion information of the timing system, and wherein the temperature activated switch comprises a low melting point substance that is non-conductive when solid and conductive when in a liquid state.

30. The timing device of claim 29, wherein the temperature activated switch comprises a non-conductive substance.

31. A timing device comprising:

a. an RFID tag electrically decoupled from an antenna of the RFID tag; and b. a temperature activated switch coupled to the RFID tag, wherein the switch changes state to open or closed when the timing device reaches or vacates a defined temperature and causes the RFID tag to become active or inactive such that the RFID tag is able to receive and transmit RF data or stops receiving and transmitting data, and wherein the RFID antenna transmits temperature excursion information of the timing device, and wherein the switch comprises a low melting point substance which upon melting contacts multiple electrical contact points throughout the timing system.

32. An electrochemical timing device comprising:

a. a lens for viewing a expiration of the timing device, b. a base, c. a cathode layer coupled to the lens and the base;

d. an anode layer coupled to the lens and the base; and e. an activatable switch for activating the device, wherein the switch changes state to activate the device and establishes an electron path between the anode layer and the cathode layer, and wherein the switch comprises a solid electrolyte that becomes active when the electrolyte liquifies.

33. The electrochemical timing device of claim 32, wherein the switch is temperature activated.

34. The electrochemical timing device of claim 32, wherein activation of the timing device indicates that a temperature excursion has taken place and indicates a duration of the temperature excursion.

* * * * *